US009490588B2

(12) United States Patent
Keyser et al.

(10) Patent No.: US 9,490,588 B2
(45) Date of Patent: Nov. 8, 2016

(54) HIGH PERFORMANCE CABLE WITH FARADAY GROUND SLEEVE

(75) Inventors: Frank T. Keyser, Elk Grove Village, IL (US); Reggie Crane, Little Rock, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/131,246

(22) PCT Filed: Jul. 3, 2012

(86) PCT No.: PCT/US2012/045341

§ 371 (c)(1),
(2), (4) Date: Apr. 9, 2014

(87) PCT Pub. No.: WO2013/006592

PCT Pub. Date: Jan. 10, 2013

(65) Prior Publication Data

US 2014/0220822 A1 Aug. 7, 2014

Related U.S. Application Data

(60) Provisional application No. 61/505,257, filed on Jul. 7, 2011.

(51) Int. Cl.

| | |
|---|---|
| ***H01R 9/03*** | (2006.01) |
| ***H01R 13/6592*** | (2011.01) |
| ***H01R 13/6595*** | (2011.01) |
| *H01R 12/53* | (2011.01) |

(52) U.S. Cl.
CPC ..... *H01R 13/6592* (2013.01); *H01R 13/6595* (2013.01); *H01R 9/037* (2013.01); *H01R 12/53* (2013.01)

(58) Field of Classification Search
CPC ..... H01R 13/6592; H01R 13/6595; H01R 9/037; H01R 12/53
USPC ..... 439/607.46, 607.5, 108, 98, 579, 497
See application file for complete search history.

(56) References Cited

U.S. PATENT DOCUMENTS

| | | | | |
|---|---|---|---|---|
| 5,716,236 | A | 2/1998 | O'Sullivan et al. | |
| 6,722,898 | B2 * | 4/2004 | Peloza et al. | 439/108 |
| 2003/0073331 | A1 | 4/2003 | Peloza et al. | |
| 2010/0294530 | A1 | 11/2010 | Atkinson et al. | |

FOREIGN PATENT DOCUMENTS

| | | | |
|---|---|---|---|
| JP | 2001-035567 | A | 2/2001 |

OTHER PUBLICATIONS

International Search Report for PCT/US2012/45341, Jan. 28, 2013.

* cited by examiner

*Primary Examiner* — Javaid Nasri
(74) *Attorney, Agent, or Firm* — Stephen L. Sheldon

(57) ABSTRACT

An improved termination assembly for a multi-wire cable is disclosed. The assembly includes a carrier member that includes wire nest portions spaced along a base portion. The wire nest portions are hollow enclosures that contact the exterior grounding shields of the cable wires so as to electrically interconnect all of the cable wires together through a common ground.

20 Claims, 9 Drawing Sheets

HIGH PERFORMANCE CABLE WITH FARADAY GROUND SLEEVE

REFERENCE TO RELATED APPLICATIONS

The Present Disclosure is a national phase of PCT Application No. PCT/US2012/045341, filed Jul. 3, 2012, which in turn claims priority to prior-filed U.S. Provisional Patent Application No. 61/505,257, entitled "High Performance Cable With Faraday Ground Sleeve," filed Jul. 7, 2011 with the United States Patent And Trademark Office, which is incorporated herein by reference in its entirety.

BACKGROUND OF THE PRESENT DISCLOSURE

The Present Disclosure relates generally to connectors utilized in high speed applications, and more particularly, to improved high speed connectors that provide a commoning, or carrier member, for uniting the grounds of the wires in a cable terminated to the connector and holding the wires in a preselected arrangement.

The speeds of electrical devices are increasing and many electronic devices today are transmitting data at data rates of 12 to 25 Gb/sec. These electronic devices rely upon transmission lines to transmit signals between related devices or peripheral devices. These transmission lines utilize signal cables that use what are known as twin-axial wires, i.e., wires that have a pair of signal wires that are twisted together along the length of the cable. The wires are held in an insulative covering and the pair of such wires is usually encircled by an associated grounding shield, such as a metal braided tube or a conductive foil. The grounding shield is then encased by an insulating covering.

In order to maintain the electrical performance integrity with such a transmission line or cable through to the connection of an associated electronic device, it is desirable to have substantially constant impedance from the transmission line to the device circuitry to avoid large discontinuities in the system impedance. Problems in controlling the impedance of a connector at a connector mating interface are well known, and where the system impedance changes greatly, the signal strength may be reduced and some of the signal is reflected back to the signal source.

Twisted wire cable is designed to maintain a desired impedance through an electrical transmission line, and this is accomplished by maintaining a constant geometry or physical arrangement of the signal conductors and the grounding shield, including the spacing between the signal conductors and all of the grounds associated therewith. Unfortunately, an impedance drop usually is encountered in the termination area where the cable is terminated to a connector. This occurs when the signal conductors of a twisted pair are untwisted, oriented to mate with the termination portions of the cable connector and soldered thereto. It is therefore desirable to maintain a desired impedance as constant as possible throughout the connector and its termination to the cable.

When a signal cable is terminated to a connector, the twisted wires are untwisted and the outer grounding shield surrounding the wire pairs may be peeled back. This often results in moving the signal wires and/or the grounding shield out of their original geometry in which they exist in the cable. This introduces variability into the electrical performance. This rearrangement may further lead to a decoupling of the ground and signal wires from their original state and it often results in an increase of impedance of the electrical assembly in the cable-connector termination area as compared to that of the cable. This increase in impedance may exceed the tolerances designed for the connector system and lead to large impedance discontinuities for the system, which will deleteriously impact the electrical performance of the system. This variability and rearrangement changes the physical characteristics of the system in the termination area, resulting in problems caused by an undesirable change in the impedance of the system through the connector interface.

The Present Disclosure is therefore directed to a termination structure in the form of a grounding carrier that both holds the cable wires and their associated signal conductors in a preselected orientation and which provides interconnects the grounds associated with each of such wires.

SUMMARY OF THE PRESENT DISCLOSURE

Accordingly, there is provided a grounding structure in the form of a carrier that is suitable for use in high speed data transfer applications and which carrier positions the cable wires with respect to each other and which interconnects the associated grounding shields together so that they may be attached, as a unit, to a circuit card.

In accordance with an embodiment as described in the Present Disclosure, a connector is provided to which the wires of a cable are terminated. The connector is of the type that inserts in the fashion of a plug connector, into a receptacle in an electronic device. The connector includes an elongated rectangular housing that houses a circuit card, known in the art as an edge card or a paddle card. The edge card has a plurality of contact pads arranged along a mating end thereof and circuitry that connects the contact pads to a termination area. A multi wire cable is connected to the circuit card. The wires in the cable are preferably of the twin-axial type with two signal conductors that run lengthwise of the cable in a twisted fashion. Each wire may be held in its own insulative covering or the two conductors may be encased by a single insulative covering. A grounding shield extends around the outside of the insulative covering of each wire pair and the shield is further covered by an outer insulative jacket.

The insulative covering is stripped from the ends of the wires to expose the wire conductors, and they are held by a carrier member, similar to a wire clamp, that holds the wires together as a unit in a preselected spacing and at preselected positions so that the wires are arrayed in a spaced-apart pattern. The carrier member is formed of a conductive material and the member has a base portion that has a preselected width. The base portion has a plurality of wire-accommodating portions in the form of nests disposed thereon, which receive the wires such that each portions lies adjacent to a respective wire. In the various embodiments disclosed, the carrier member may include a corrugated configuration with a series of alternating peak and valley portions, the peak portions of which define hollow nests that receive individual wires therein, and the valley portions of which provide a flat contact surface for engaging a ground plane of the circuit card. In another embodiment, the carrier member may include a base member that extends widthwise of the ground plane and which has individual, hollow nests formed at spaced-apart intervals. Crimping legs are associated with each nest portions and are stamped from the carrier member so that they may be bent over to define the hollow aspect of the nest portions and into contact with the grounding shield exposed on the exterior surfaces of the cable wires. The crimping legs are staggered so as to provide the most economical use of the material from which the carrier member is formed.

In another embodiment as described herein, the carrier member is used in association with an additional grounding member which is particularly suitable for backplane applications. A conductive sheet is provided with a plurality of spaced apart contacts that extend up and forwardly from a common edge to define a series of ground contacts that in effect surround the wire pairs of the cable which are held by the grounding carrier member, These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
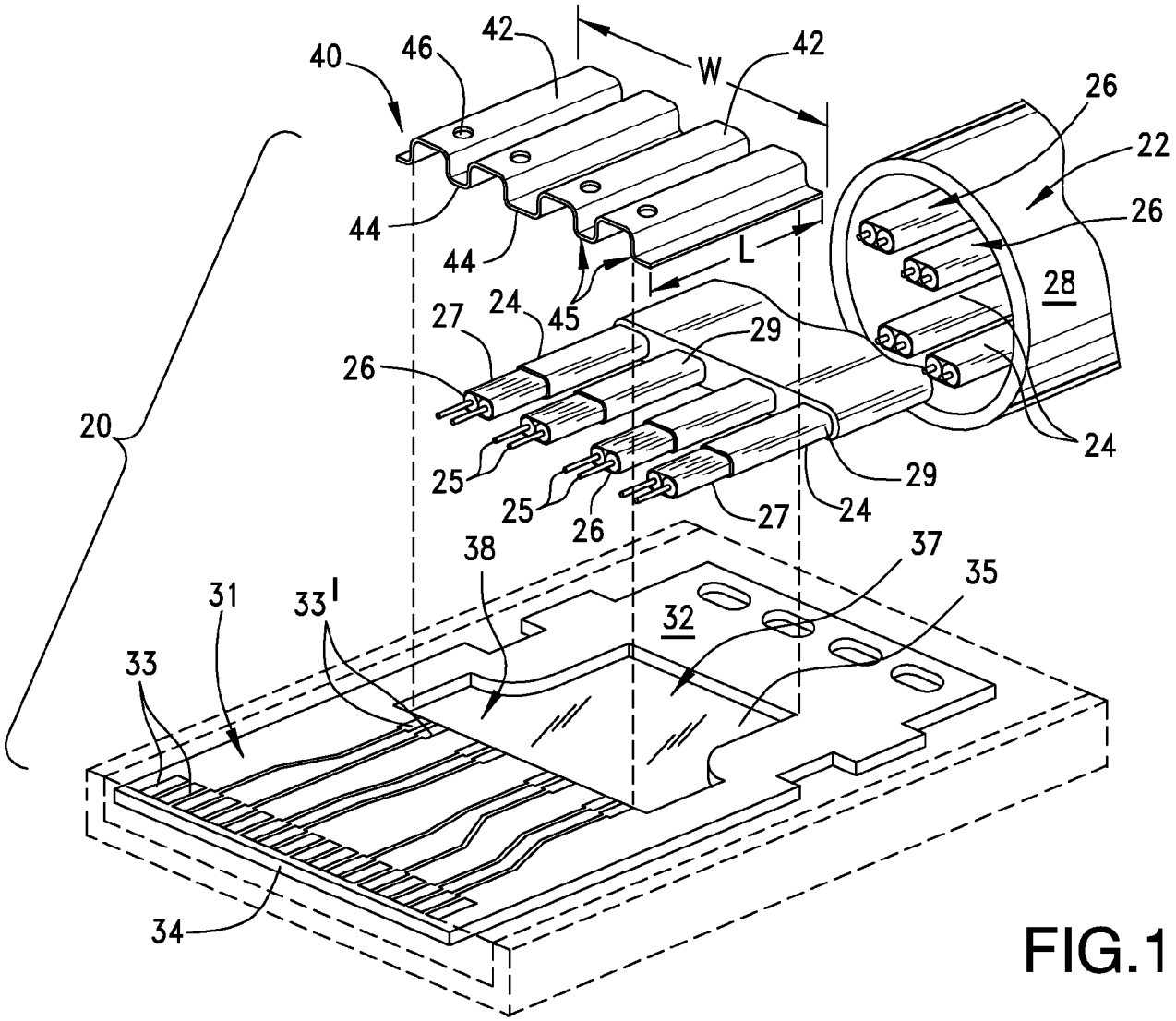
FIG. 1 is an exploded view of a first embodiment of a cable connector constructed in accordance with the principles of the Present Disclosure and utilizing a corrugated carrier member.

FIG. 1 illustrates a plug connector 20 in phantom that is connected to a multi-wire cable 22. The cable contains a plurality of twin-axial wires 24, with each such wire 24 including two conductors 25 that are held in an insulative covering 26 that may be either a single covering or dual covering, that is, one covering 26 associated with a pair of the conductors 25. The wires 24 are then wrapped in an outer grounding shield 27 in the form of a braid or foil, or the like and the shield is thereupon wrapped in an outer insulative covering 29 to form a wire pair assembly and that assembly is then housed in an exterior insulative cable covering, or sheath 28, that defines the shape and configuration of the cable 22. Free ends 29 of the wires are exposed and arranged in a pattern, as illustrated and the wires may be fixed in their pattern by a strain relief member 30 or the like that may be molded over the wires 24 and which serves to keep them in place within their selected arrangement.

The connector 20 is a plug-style connector and includes an internal mating blade 31 housed in a slot in the connector housing and this mating blade 31 takes the form of a circuit card 32 that is commonly referred to in the art as a paddle card or edge card. The circuit card 32 has an elongated, rectangular configuration, with a plurality of conductive contact pads 33 arranged along a leading, or mating, edge 34 thereof and termination pads 33' disposed rearwardly of the leading edge 34. Circuitry on the circuit card 32 provides circuit paths between the contact pads 33, 33' and the wire conductors 25 of the cable wires 24. The circuit card 32 is formed with its circuitry on a variety of discrete layers as is known in the circuit card art and at least one of these layers is a conductive ground plane layer 35 that extends for almost the entire surface of the circuit card 32 in a designated horizontal plane thereof. In connectors constructed in accordance with the Present Disclosure, this ground plane layer 35 is exposed to form a wire mounting area 37 of the circuit card 32. The wire mounting area 37 is defined by the removal of selected layers of the circuit card 32 and the removal of these selected layers creates a well, or recessed tray 38 on the circuit card 32.

As noted above, each of the twin-axial wires 24 has a grounding shield associated with it and this grounding shield 27 extend the entire length of the wire 24 and the cable 22. It is desired to interconnect the grounding shields 27 of each of the twin-axial wires 24 for better signal separation, coupling and other benefits. In conventional cable plug connectors, the outer insulation of each wire is removed and the outer conductive braids or foils of each of the wires is subsequently attached to ground pads on the circuit card such as by soldering. This process is tedious and is labor-intensive. Care should be taken to ensure that the outer conductive layers of the wires are trimmed at approximately the same location for each wire and further soldered to the circuit card along a common datum. With an individual wire application process, that is a difficult task.

In accordance with the Present Disclosure, we have developed a dual function carrier member 40 that firstly acts as a ground clamp in that it holds the cable wires 24 in a preselected positional arrangement. Secondly, the carrier member 40 acts as a commoning member that electrically interconnects the external grounding shields 27 of the cable wires 24 together. Due to its structure, the cable wires 24 may be cut and exposed along a uniform length and the cable wires 24 may then be commoned by way of their outer grounding shields 27 at the same location throughout the wire arrangement. The carrier member 40 also facilitates the attachment of the cable wires 24, as a set, to the circuit card ground plane 35. The carrier member 40 also assists in locating the cable wires 24 in position so that the conductors of each cable wire 24 is the same distance from the circuit card ground plane 35, resulting in better electrical uniformity through the connector.

Figure 2:
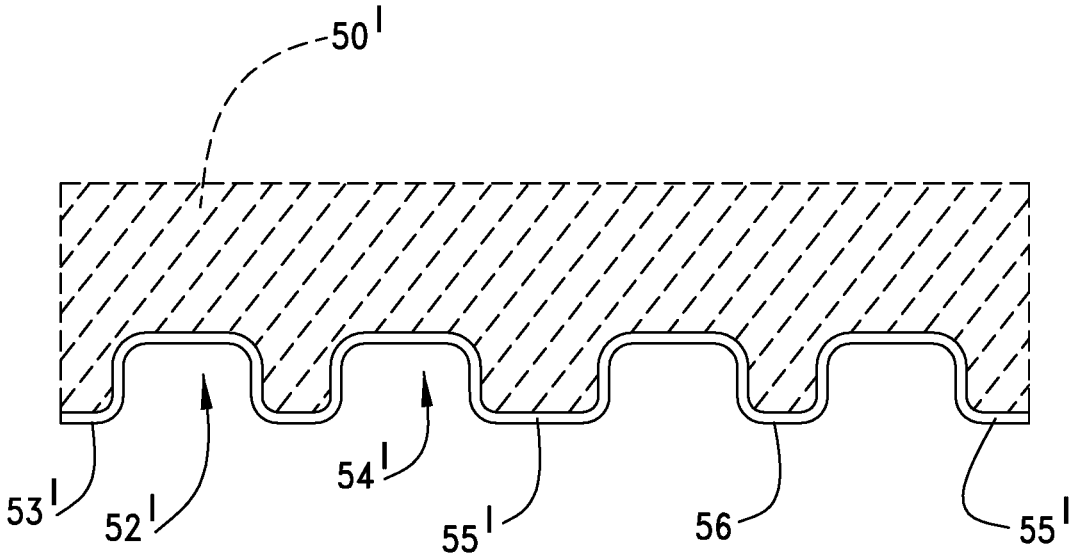
FIG. 2 is a front elevational view of the carrier member of FIG. 1.
Figure 3:
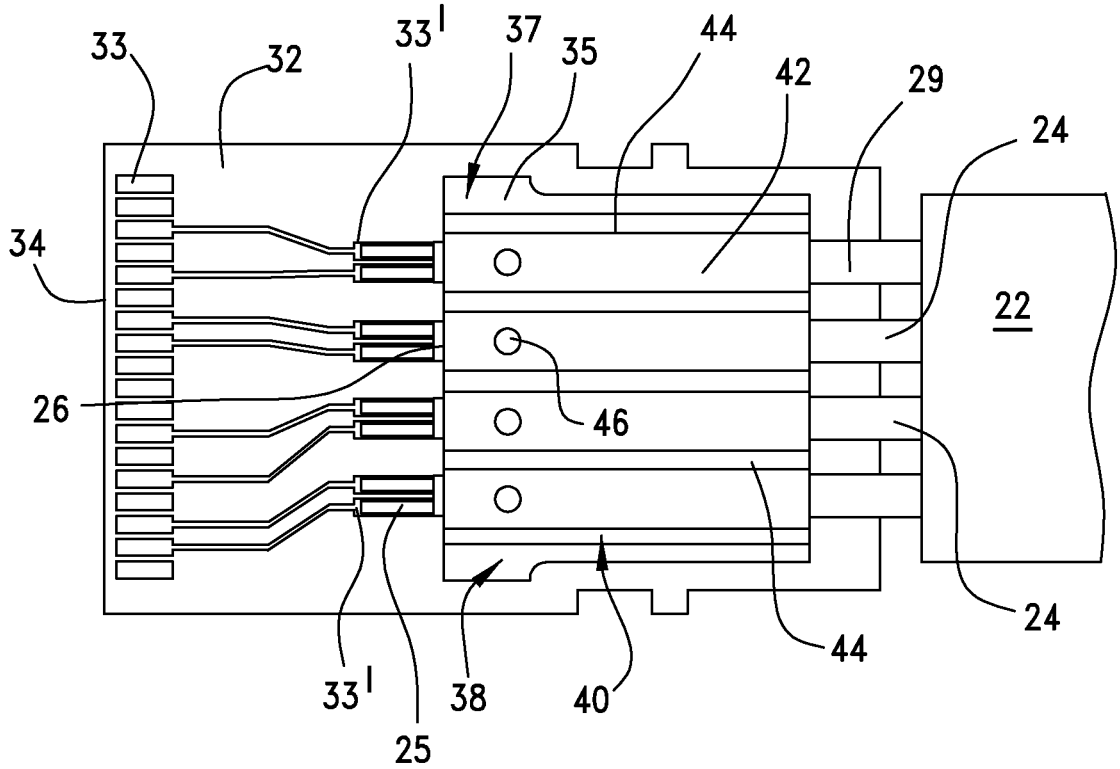
FIG. 3 is a perspective view is a top plan view of the connector of FIG. 1, but assembled together with the carrier member and its associated wires attached to a ground plane of the circuit card.

FIG. 1 illustrates a first embodiment of a carrier member 40 of the Present Disclosure. The carrier member is preferably formed from a piece of conductive material, such as copper sheet metal and has a preselected width, W and a preselected length L so that it has a generally rectangular appearance when viewed from above or below. As depicted in FIGS. 1-3, the carrier member 40 has a corrugated configuration, meaning that is has a plurality of peak portions 42 and valley portions 44 defined therein. The peak portions 42 define lengthwise hollow enclosures, or nests, that receive a portion of a twin-axial wire 24 therein, while the intervening valley portions 44 act cooperatively as a base in that they define inverted, flat contact surfaces 45 that will contact the ground plane layer 35 of the circuit card 32 and which can be reliably attached to the ground plane layer 35 as by soldering or the like. In order to verify that the carrier member 40 has been soldered properly to the ground plane layer 35 and the wire grounding shield of each of the cable wires, a series of inspection holes 46 may be formed in the peak portions 42 as illustrated. The carrier member 40 may be formed from either a solid sheet metal blank, or it may be formed from a conductive screen material which is stamped and formed into the preferred corrugated configuration. If a screen material is used, then there is no need to form for the inspection holes 46 in the carrier member 40 as the openings in the screen material will permit visual inspection.

In yet another embodiment of the Present Disclosure and as illustrated in phantom in FIG. 3, the carrier member may be formed from an insulative block 50', utilizing plastic, or a suitable molding resin and the block 50' may have peak portions 52' cut into it along a bottom surface 53' thereof. The dashed lines in FIG. 3 represent the plastic block as it supports a conductive carrier member surface. Likewise, the solid lines in FIG. 3 define an end view of the corrugated carrier member 40. These peak portions 52' of the block 50' define the nests, or wire-receiving portions 54' of the block 50' while the intervening valley portions 55' define the contact (or mounting) surfaces 56' of the block 50' that are intended to make contact the circuit card ground plane layer 35. In order to provide the desired commoning aspect, the bottom surface 53' of the block 50' may be plated with a layer 55' of conductive material, or the conductive material may be hot stamped thereon.

Figure 4:
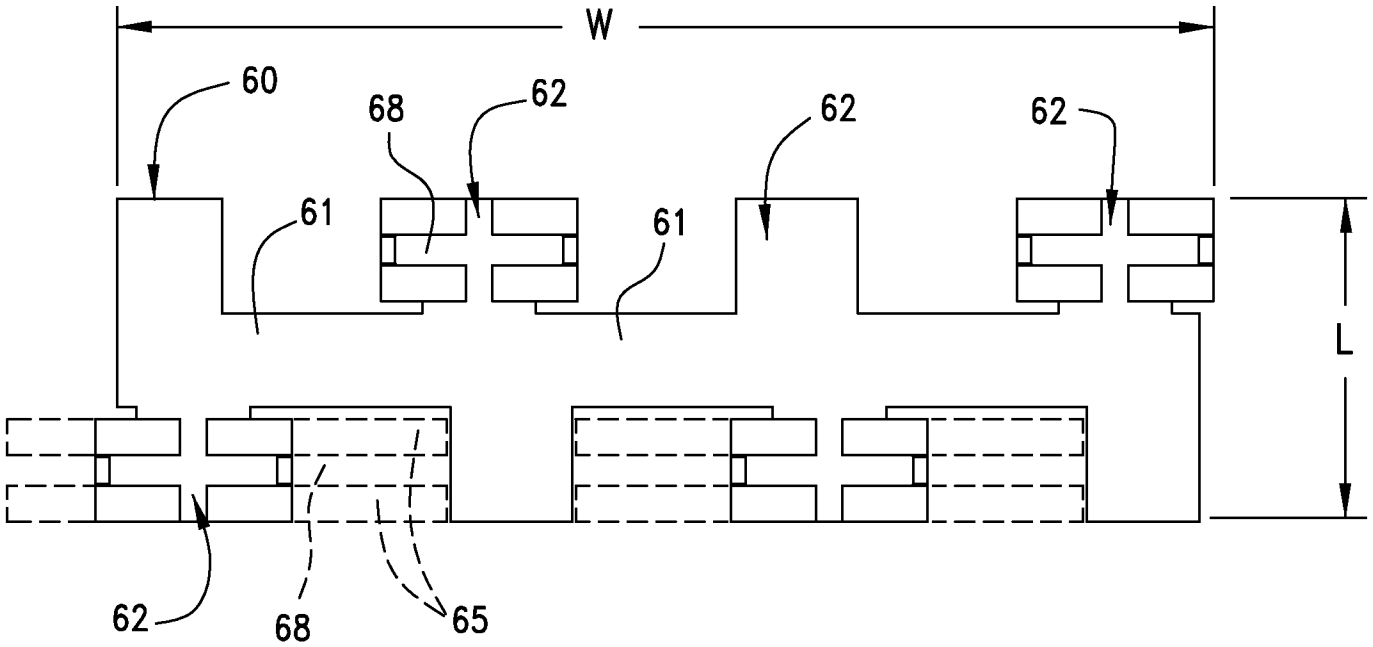
FIG. 4 is a top plan view of another embodiment of a carrier member constructed in accordance with the principles of the Present Disclosure, with some of the crimping legs thereof shown in phantom to represent their position before forming of the carrier member.
Figure 5:
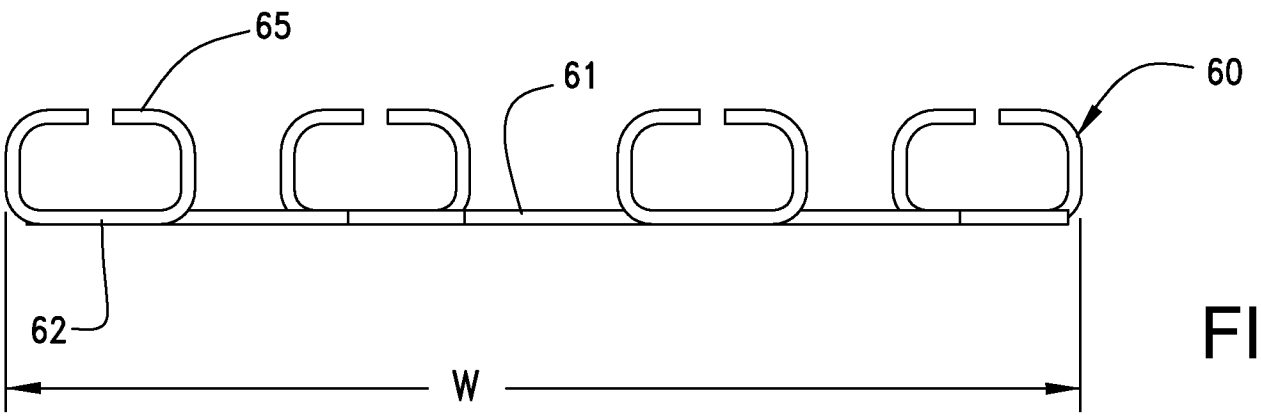
FIG. 5 is a front elevational view of the carrier member of FIG. 4.
Figure 4A:
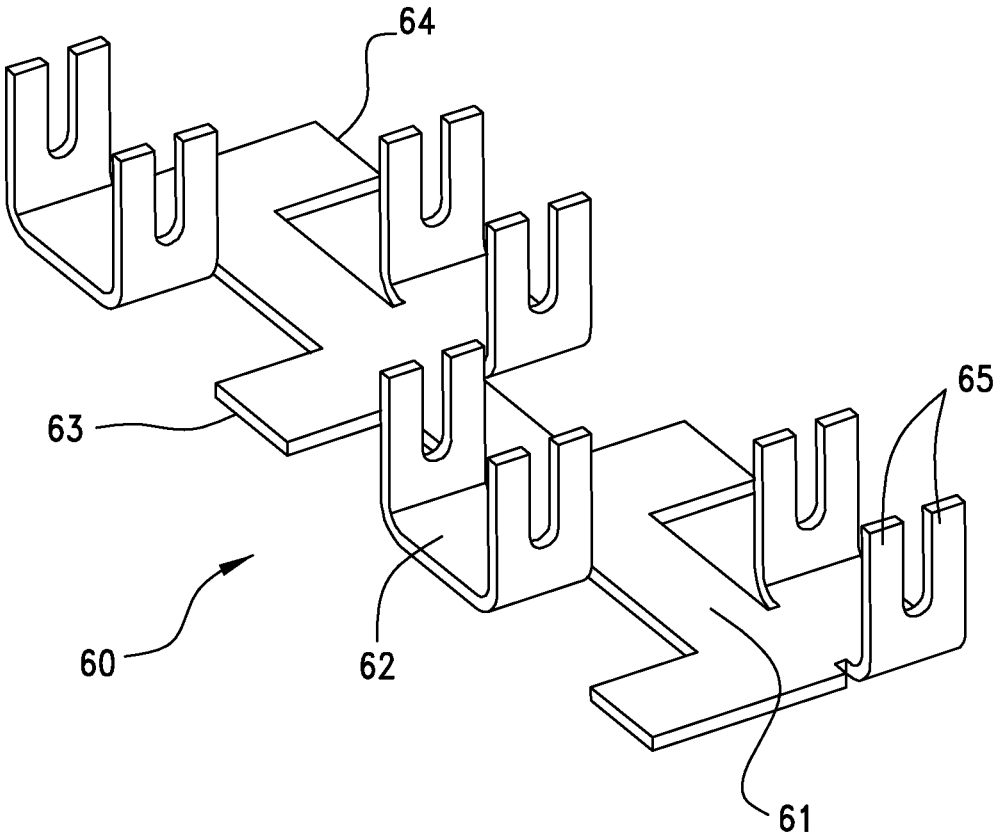
FIG. 4A is a perspective view of the carrier member of FIG. 4, with its crimping legs in an initial stage of forming and initially defining the hollow enclosures of the nest portions.
Figure 6:
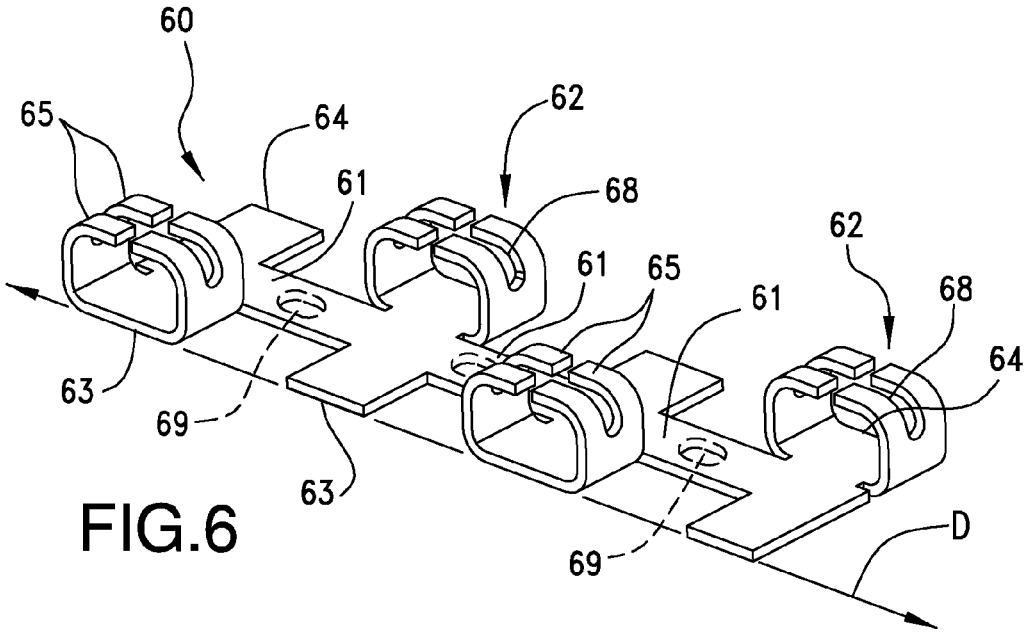
FIG. 6 is a perspective view of the carrier member of FIG. 4.
Figure 6A:
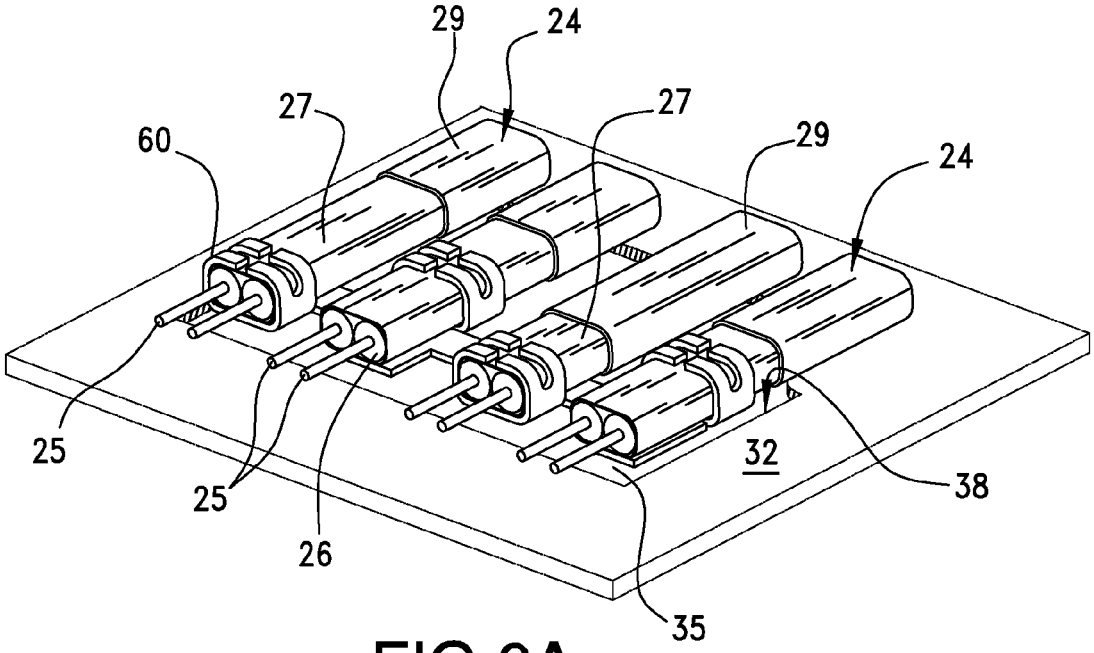
FIG. 6A is a perspective view of the carrier member of FIG. 6 engaging four twin-axial wires of a cable and positioned in place for attachment to a circuit card.

FIGS. 4 & 5 depict another carrier member 60 in accordance with the Present Disclosure. FIG. 4 is a top plan view of the carrier member 60, whilst FIG. 6 is a perspective view of the same member. This carrier member 60 includes a base portion 61 that extends widthwise for a preselected distance, preferably equal to or slightly less that the width dimension of the circuit card ground plane recess 38 that exposes the ground plane layer 35. The carrier member 60 includes a series of nest portions 62 that are spaced apart in a pattern along the base portion 61 and which are interconnected together by the base portions 61. These nest portions 62 include lengthwise base portions with front and rear ends 63, 64. Each nest portion 62 is further preferably provided with means for reliably engaging the cable wires on a singular basis, which are shown as pairs of crimping legs 65 that are stamped from the carrier member 60 and are bent upwardly and inwardly as shown. Once the crimping legs 65 are formed erect, they define hollow enclosures into which the cable wires 24 may be placed, then the crimping legs may be further formed and bent over into contact with the exterior grounding shields 37 of their respective wires 24.

Figure 7:
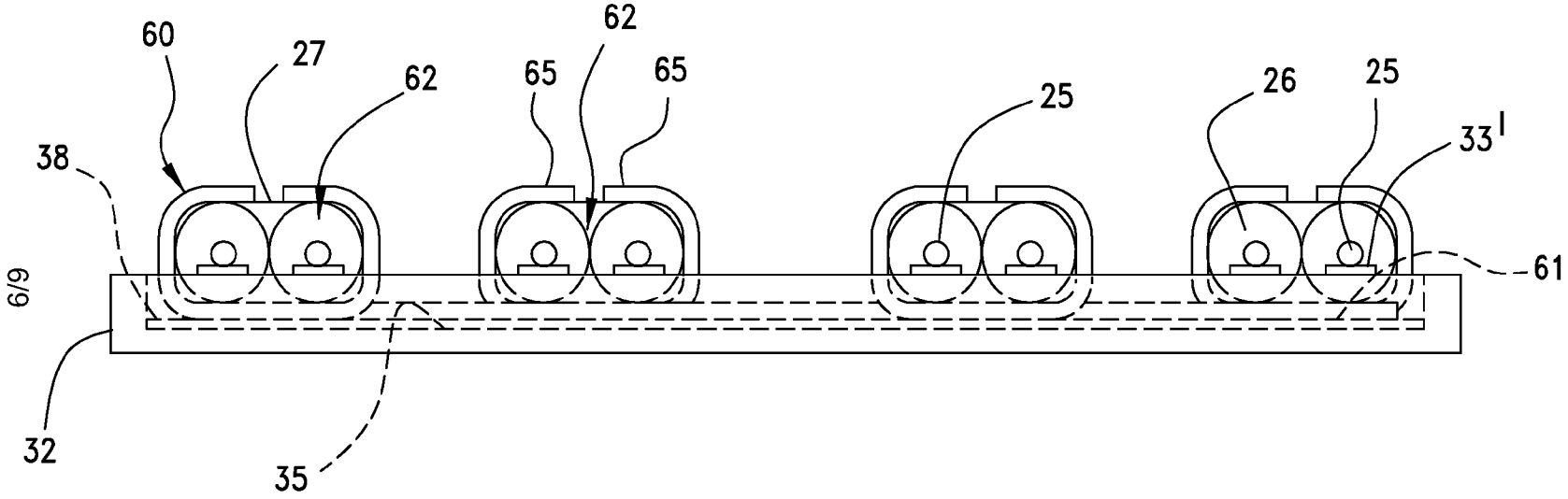
FIG. 7 is a front elevational view, taken through the body of a circuit card, illustrating the carrier member of FIG. 6A in place on a circuit card and in contact with the ground plane thereof.

The carrier member 60 may be stamped from sheet metal, such as a copper blank so that the nest and base portions 62, 61 are formed integrally with each other. The crimping legs 65, as illustrated, are formed in the blank adjacent the nest portions and extend sideways, or perpendicular thereto, so as to enable their upward and over bending onto the exterior surfaces of the cable wires 24. Slots 68 may be provided to define pairs of crimping legs 65 on each side of a nest portion 62, with two pairs of crimping legs 65 being associated with each twin-axial wire 24 of the cable 22. The front edges 63 of the nest portions 62 define a datum line D that may be used by the operator to visually locate the cable wires 24 in their desired placement on the carrier member 60 in a lengthwise spacing with respect to the circuit card termination contact pads 33'. This datum line is important as it places all of the cable wires in a preferred alignment so as to maintain the uniformity of the termination of the wires so as not to introduce any geometric or dimensional variations that would affect the electrical characteristics of the connector, including the electrical length of each cable wire circuit. Moreover, as illustrated in FIG. 7, the carrier member 60 maintains the cable wires 24 as a unit in place so that their associated conductors 25 contact the termination pads 33' of the circuit card 32 at approximately the same level of height.

After the cable wires are stripped and their free ends prepared and their grounding shields exposed, they are placed onto the carrier member 60 and the crimping legs 65 are pressed into contact with the wire grounding shields. The cable wires 24 and the carrier member 60 thereby form a unitary structure that is subsequently places into the circuit card mounting recess 38 in contact with the ground plane 35. It is then attached to the circuit card 32, such as by way of a reflow soldering process. The raised height of the carrier member 60 provides a hard edge against the circuit card ground plane 35 which promotes the formation of a reliable solder fillet between the carrier member 60 and the ground plane 35. So too, the crimping leg slots 68 form a solder collection area where the solder can accumulate to reliably connect the carrier member crimping legs 65 to the exposed grounding shields 27 of the cable wires 24. The slots 68, with their parallel sides, also promote the flow of solder entirely through the slots. In this manner, the carrier members of the Present Disclosure may be easily visually inspected to ensure that a reliable solder connection has indeed been made between it and the circuit card ground plane layer 35.

In an alternate arrangement, the carrier member 60 may include as shown in FIG. 6, openings 69 may be formed in the base portions thereof that will permit collection of solder and permit a visual inspection of the carrier member connection. The carrier member 60 may be pre-tinned to facilitate solder attachment and eliminate the need for utilizing a solder flux. Stamping and forming the carrier member from sheet metal eliminates the problem of flags, i.e., hanging shield particulate matter which can deleteriously interfere with the impedance profile through the terminations area.

Figure 8:
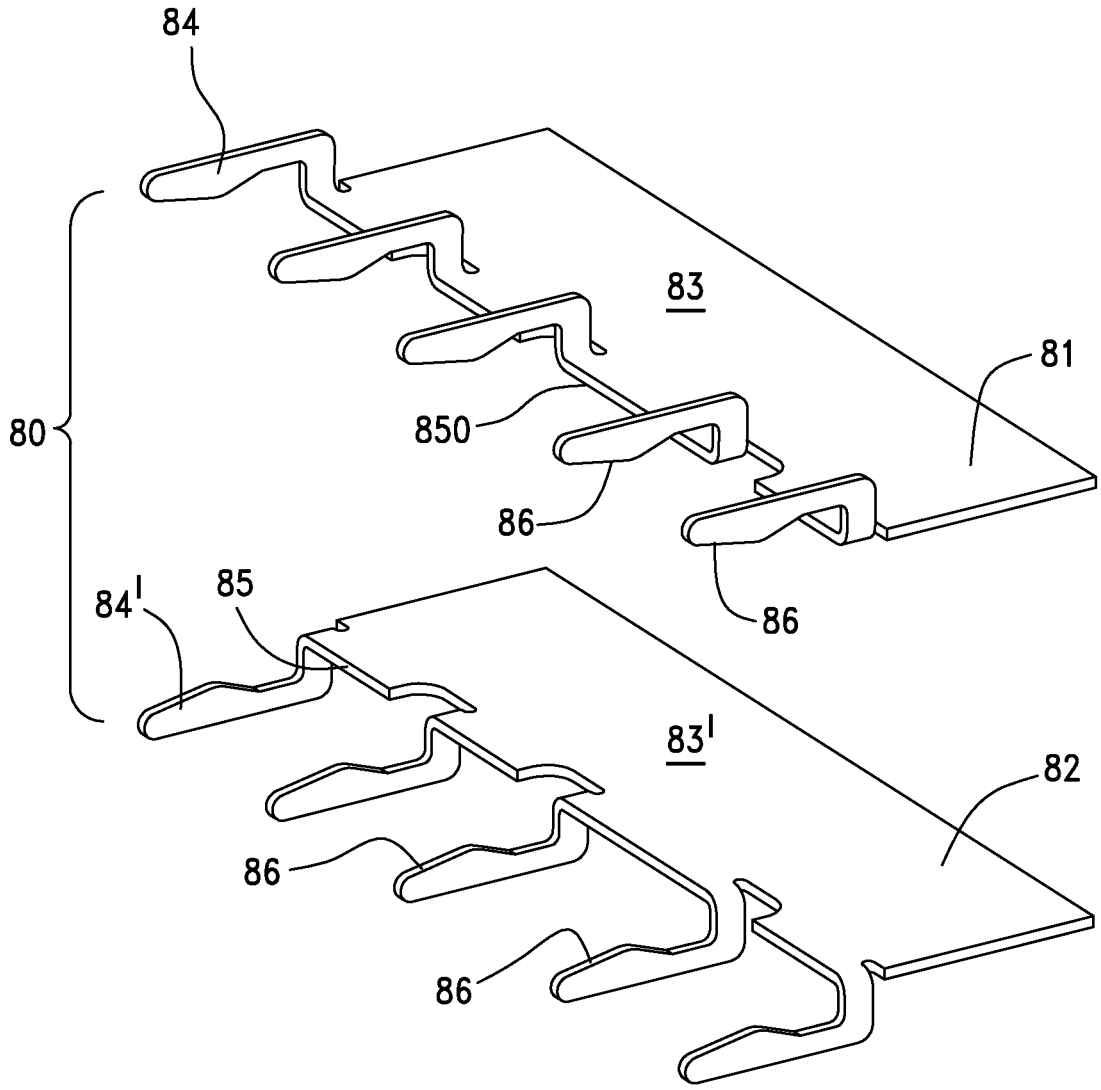
FIG. 8 is a perspective view of a pair of grounding plates that may be used in association with the carrier members of the Present Disclosure to provide grounding to another circuit board.
Figure 8A:
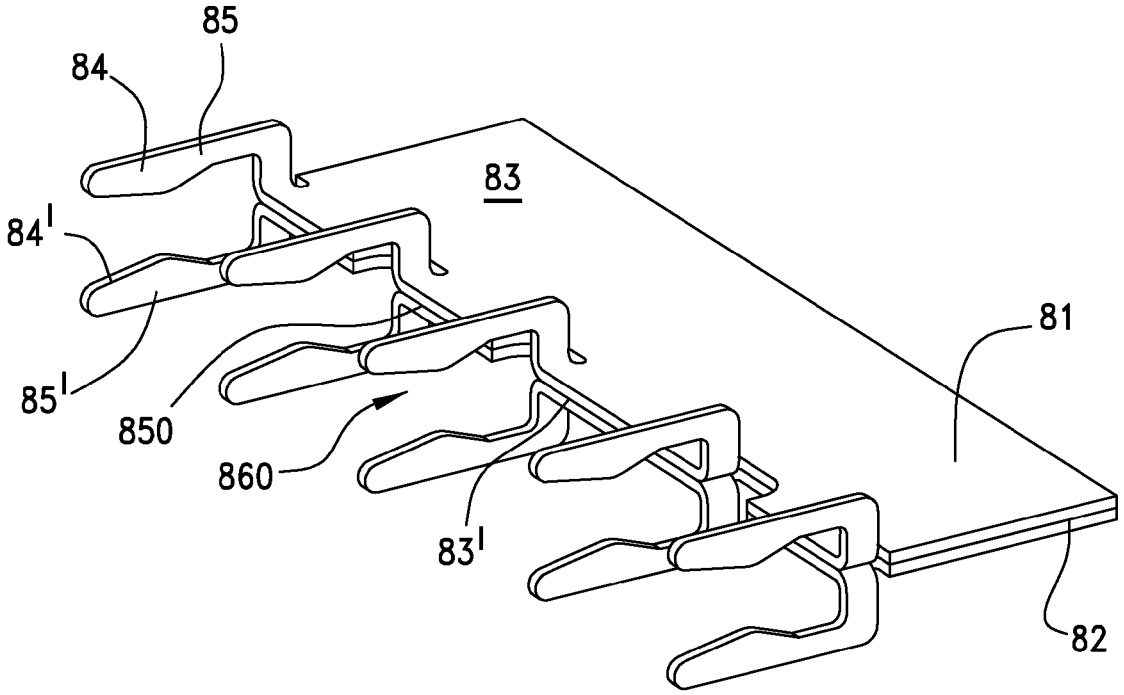
FIG. 8A is the same view as FIG. 8, but with the pair of grounding plates moved together for their application to form a ground plane assembly.
Figure 8B:
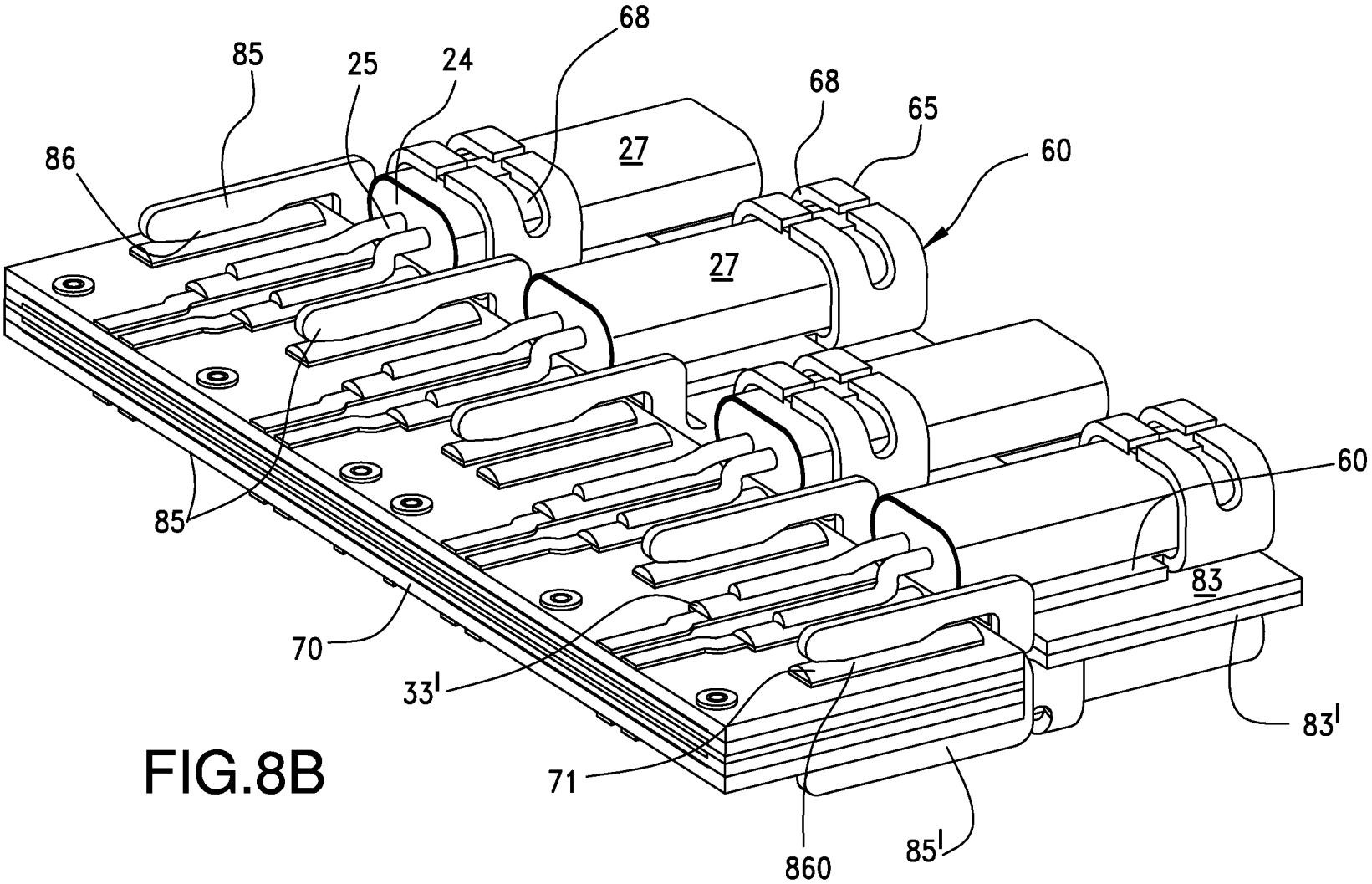
FIG. 8B is a perspective view of the ground plate assembly of FIG. 8A with two grounding carrier members of the Present Disclosure engaged with cable wires to provided grounding to an additional circuit board.

FIGS. 8-8B illustrate and alternate embodiment of the grounding carrier member of the Present Disclosure that is particularly suitable for use in backplane applications. In this embodiment, a ground plane assembly 80 is formed from combining two grounding plates 81, 82 together. Each grounding plate 81, 82 includes a ground plane portion 83, 83' and a plurality of contacts 84, 84' that are formed from the plates 81, 82 along a common edge 850 thereof. The contacts 84, 84' are stamped from the plates 81, 82 and bent upwardly or downwardly so that cantilevered contact arms 85, 85' are formed. The contact arms 85, 85' are provided in number so that pairs of such contact arms 85, 85' flank each of the cable wires 24 present. The contact arms 85, 85' are further arranged in pairs as between respective grounding plates 81, 82 so that an internal cavity 860 is defined therebetween. This cavity 860 accommodates an additional circuit board 70 such as a backplane so that this embodiment may be used in mating cables to backplanes. Likewise, the contact arms 85, 85' are spaced apart from each other in the widthwise direction in order to provide grounding contact on opposite sides of each wire pair of the cable.

This arrangement is best illustrated in FIG. 8B wherein an additional circuit board 70 is shown inserted into the cavity 860 defined between the pairs of contact arms 85, 85'. The circuit board 70 is more in the nature of a multi-layer backplane and includes termination pads for the signal conductors 25 of the cable wires 24 and termination pads 71 for the ground contact arms 85, 85'. The ground contact arms 85, 85' include contact surfaces 86, 86' that are disposed forward of the common edge 850 of the ground plates 81, 82. Pairs of the ground contact arms are spaced apart from each other widthwise and thereby place a ground contact arm on each side of any cable wire 24 in such a system. This provides very reliable and consistent shielding and coupling through the transition from the cable to the backplane 70. In this embodiment, the grounding plates 81, 82 take the place of the circuit card ground plane 35.

While a preferred embodiment of the Present Disclosure is shown and described, it is envisioned that those skilled in the art may devise various modifications without departing from the spirit and scope of the foregoing Description and the appended Claims.

What is claimed is:

1. A carrier for terminating a multi-wire cable, the multi-wire cable including a plurality of electrical wires, pairs of the electrical wires being encased in an insulative covering, each insulative covering including an exterior grounding shield associated therewith, the carrier holding the cable wire pairs in a preselected position and further interconnecting the cable wire pairs together to define a common ground, the carrier comprising:

a conductive carrier member, the conductive carrier member including a preselected width large enough to permit spacing of the cable wire pairs thereupon in a pattern, wherein adjacent cable wire pairs are separated by an intervening space, the conductive carrier member including a plurality of nest portions defining a hollow enclosure for receiving and contacting one of the cable wire pairs, each nest portion including contact portions for contacting exterior grounding shields of the cable wire pairs and being interconnected together by base portions, each base portion including mounting surfaces for contacting and mounting the conductive carrier member to a ground plane of a connector, wherein the conductive carrier member is formed from an insulative block.

2. The carrier of claim 1, wherein the conductive carrier member further includes a corrugated configuration such that the mounting surfaces are interposed between the nest portions.

3. The carrier of claim 1, wherein the conductive carrier member further includes a plurality of peak and valley portions.

4. The carrier of claim 3, wherein each peak portion is separated from each other by intervening valley portions.

5. The carrier of claim 4, wherein each peak portion defines one of the nest portions.

6. The carrier of claim 5, wherein each valley portion defines one of the mounting surfaces.

7. The carrier of claim 1, where each nest portion is staggered lengthwise with respect to each other along the conductive carrier member.

8. The carrier of claim 1, wherein the insulative block includes a plurality of insulative block peak and valley portions formed along one surface thereof.

9. The carrier of claim 8, wherein each insulative block peak portion defines a nest portion and each insulative valley portion defining a mounting surface of one of the base portions.

10. The carrier of claim 9, wherein the mounting surface includes a conductive material disposed thereon.

11. The carrier of claim 1, wherein each nest portion further includes a plurality of crimping legs.

12. The carrier of claim 11, wherein each crimping leg is foldable over and onto a cable wire pair inserted into the nest portion.

13. The carrier of claim 12, wherein each nest portion further includes two pairs of crimping legs.

14. The carrier of claim 13, wherein the two pairs of crimping legs are disposed along each nest portion in an opposing arrangement.

15. The carrier of claim 13, wherein the crimping legs are arranged in pairs and each pair of crimping legs includes a slot interposed therebetween.

16. The carrier of claim 1, wherein the conductive carrier member further includes a leading edge that defines a cable wire alignment datum line for positioning the cable wires on the conductive carrier member in a preselected arrangement.

17. The carrier of claim 1, wherein each base portion extends in a transverse direction and each nest portion extends at an angle to the base portions.

18. The carrier of claim 17, wherein each base portion extends in a transverse direction and each nest portion extends past opposing edges of the base portions.

19. The carrier of claim 1, wherein the conductive carrier member further includes at least one visual inspection opening formed therein that permits visual inspection of an attachment method used to attach the conductive carrier member to a ground plane.

20. A carrier for terminating a multi-wire cable, the multi-wire cable including a plurality of electrical wires, pairs of the electrical wires being encased in an insulative covering, each insulative covering including an exterior grounding shield associated therewith, the carrier holding the cable wire pairs in a preselected position and further interconnecting the cable wire pairs together to define a common ground, the carrier comprising:

a conductive carrier member, the conductive carrier member including a preselected width large enough to permit spacing of the cable wire pairs thereupon in a pattern, wherein adjacent cable wire pairs are separated by an intervening space, the conductive carrier member including a plurality of nest portions defining a hollow enclosure for receiving and contacting one of the cable wire pairs, each nest portion including contact portions for contacting exterior grounding shields of the cable wire pairs and being interconnected together by base portions, each base portion including mounting surfaces for contacting and mounting the conductive carrier member to a ground plane of a connector, wherein the conductive carrier member is formed from a screen material.

* * * * *